US011534036B2

(12) United States Patent
Igelka et al.

(10) Patent No.: US 11,534,036 B2
(45) Date of Patent: Dec. 27, 2022

(54) TOWEL HOLDING HANDLE ASSEMBLY

(71) Applicant: Elk & Book Innovations Inc., Calgary (CA)

(72) Inventors: Hernan Carlos Igelka, Calgary (CA); Joshua Bookey, Calgary (CA)

(73) Assignee: Elk & Book Innovations Inc., Calgary (CA)

( * ) Notice: Subject to any disclaimer, the term of this patent is extended or adjusted under 35 U.S.C. 154(b) by 245 days.

(21) Appl. No.: 17/117,581

(22) Filed: Dec. 10, 2020

(65) Prior Publication Data

US 2021/0177215 A1 Jun. 17, 2021

Related U.S. Application Data

(60) Provisional application No. 62/947,042, filed on Dec. 12, 2019.

(51) Int. Cl.

| | |
|---|---|
| ***A47K 10/14*** | (2006.01) |
| ***E05B 1/00*** | (2006.01) |
| ***A47K 10/10*** | (2006.01) |

(52) U.S. Cl.

CPC ..... *A47K 10/14* (2013.01); *A47K 10/10* (2013.01); *E05B 1/0015* (2013.01)

(58) Field of Classification Search

CPC ..... A47K 10/14; A47K 10/10; A47K 10/08; A47K 10/04; A47K 10/12; E05B 1/0015

See application file for complete search history.

(56) References Cited

U.S. PATENT DOCUMENTS

| | | | | | |
|---|---|---|---|---|---|
| 261,817 | A * | 7/1882 | Mallory | A47K 10/10 | 211/16 |
| 320,211 | A * | 6/1885 | Bergsten | A47K 10/10 | 211/16 |
| 1,408,283 | A * | 2/1922 | Ferdon | A47K 10/28 | 55/354 |
| 1,646,068 | A * | 10/1927 | Rosner | A47K 10/14 | 248/316.4 |
| 2,374,787 | A * | 5/1945 | Spiegel | A47K 10/04 | 211/105.1 |
| 2,606,667 | A * | 8/1952 | Hornick | A47K 10/10 | 211/124 |
| 2,647,641 | A * | 8/1953 | Tritt | A47K 10/10 | 211/88.04 |
| 3,361,267 | A * | 1/1968 | Johnw | A47K 10/04 | 211/89.01 |
| 3,374,899 | A * | 3/1968 | Bator | A47K 10/04 | 211/96 |

(Continued)

*Primary Examiner* — Devin K Barnett

(74) *Attorney, Agent, or Firm* — Ryan W. Dupuis; Kyle R. Satterthwaite; Ade & Company Inc.

(57) ABSTRACT

A towel holding handle assembly includes a handle bar that can be mounted on a variety of supporting surfaces for use as an operating handle. The handle bar receives two elongate clamping elements within a hollow interior thereof which are accessible through an opening along one side of the handle bar. The clamping elements are biased from a released position in which the first and second clamping elements are spaced apart to receive a portion of a towel inserted therein and a clamped position in which the first and second clamping elements are closer to one to clamp the retain the inserted portion of the towel clamped therein.

20 Claims, 8 Drawing Sheets

(56) References Cited

U.S. PATENT DOCUMENTS

| | | | | |
|---|---|---|---|---|
| 3,853,225 | A * | 12/1974 | Gegauff | A47G 25/746 211/124 |
| 4,729,482 | A * | 3/1988 | Nicholson | A47K 10/04 211/6 |
| 9,198,544 | B1 * | 12/2015 | Duddie | A47K 10/10 |
| 2005/0284590 | A1 * | 12/2005 | Mariconti | A47K 10/02 160/349.1 |
| 2007/0125723 | A1 * | 6/2007 | Rockel | A47K 10/10 211/16 |
| 2008/0121598 | A1 * | 5/2008 | Brinson | A47K 10/04 211/88.04 |
| 2011/0056896 | A1 * | 3/2011 | Tzekova | A47K 10/14 211/45 |
| 2016/0113449 | A1 * | 4/2016 | Gainey | A47K 10/04 211/16 |
| 2022/0233029 | A1 * | 7/2022 | Heuer | A47K 10/10 |

* cited by examiner

TOWEL HOLDING HANDLE ASSEMBLY

This application claims the benefit under 35 U.S.C. 119(e) of U.S. provisional application Ser. No. 62/947,042, filed Dec. 12, 2019.

FIELD OF THE INVENTION

The present invention relates to a handle assembly, for example a handle on an appliance such as an oven door handle, and more particularly relates to a handle assembly incorporating a holder for holding a towel on the handle assembly.

BACKGROUND

Appliances of various types are commonly provided with a door handle, for example the handle on an oven door used for gripping in the hand of a user to open and close the oven door. Such handles are commonly horizontal in orientation and are commonly used as a towel rod over which a dish towel or hand towel of the type commonly used in a kitchen can be draped. Due to the handles commonly being smooth and ergonomic in shape, towels draped over the handles can readily fall from the handle in a manner which is a nuisance to users.

U.S. Pat. No. 3,118,542 by Lewis; U.S. Pat. No. 2,774,481 by Sievers; U.S. Pat. No. 2,645,351 by London; U.S. Pat. No. 2,143,119 by Waring; and U.S. Pat. No. 2,415,637 by Jones disclose various examples article supporting racks which provide some assistance in retaining the article on the rack. These known devices however are poorly suited for use as a handle on an object such as an appliance.

SUMMARY OF THE INVENTION

According to one aspect of the invention there is provided a handle assembly for holding a towel, the handle assembly comprising:

a handle bar extending in a longitudinal direction between opposing ends of the handle bar;

the handle bar including a hollow interior and a towel opening which is elongate in the longitudinal direction of the handle bar so as to define a pair of longitudinal edges extending in the longitudinal direction of handle bar that are spaced apart from one another so as to be arranged to receive a portion of the towel inserted into the hollow interior of the handle bar between the longitudinal edges;

a first clamping element and a second clamping element supported within the hollow interior of the handle bar and extending in the longitudinal direction of the handle bar in proximity to the pair of longitudinal edges of the towel opening respectively;

a mounting arrangement supporting the first and second clamping elements to be movable relative to the handle bar transversely to the longitudinal direction between a released position in which the first and second clamping elements are spaced apart so as to receive said portion of the towel inserted between the clamping elements and a clamped position in which the first and second clamping elements are closer to one another than in the released position; and a biasing arrangement operatively connected to the first and second clamping elements so as to bias the first and second clamping elements towards the clamped position.

Preferably the first and second clamping elements are independently movable between the clamped and released positions. Furthermore, the biasing arrangement preferably includes outer springs supported at opposing ends of the handle bar such that the opposing ends of the clamping elements are biased towards the clamped position independently of one another by the springs. The biasing arrangement may also include an intermediate spring supported at an intermediate location spaced inwardly from opposing ends of the clamping elements in which the intermediate spring is operatively connected to both of the first and second clamping elements for urging both clamping elements towards the clamped position thereof.

Use of two clamping elements which are both movable within the handle bar between clamped and released positions allows for a large opening in the released position which can accommodate a large variety of towels, while also securely clamping the towels in the clamped position.

Each of the first and second clamping elements may be displaced inwardly into the hollow interior of the handle bar away from a plane of the towel opening in the handle bar as the clamping element is displaced from the clamped position towards the released position.

Preferably each of the first and second clamping elements follows an arcuate path about a longitudinal axis oriented in the longitudinal direction of the handle bar between the clamped and released positions.

Each of the first and second clamping elements may be supported at opposing ends within a respective guide slot which guides movement of the clamping element between the clamped and released positions. The clamping elements may also be supported at an intermediate location spaced inwardly from opposing ends of the clamping element within a respective guide slot which guides movement of the clamping element between the clamped and released positions When the towel opening comprises one or more openings spanning a majority of a length of the handle bar, preferably the first and second clamping elements span a full length of the one or more towel openings.

Preferably each of the first and second clamping elements includes a clamping surface facing towards the other one of the first and second clamping elements that is convex about a longitudinal axis oriented in the longitudinal direction of the handle bar.

The clamping surfaces facing towards one another may be rigid or resilient.

One or both of the first and second clamping elements may comprise a roller which is rotatable about a longitudinal axis oriented in the longitudinal direction of the handle bar. The roller may have a textured surface.

According to one embodiment, the handle assembly may include a frame member extending in the longitudinal direction of the handle bar within the hollow interior, the frame member being generally C-shaped in profile to extend about a longitudinal axis of the frame member between opposing longitudinal edges of the frame member, in which the longitudinal edges of the frame member define the first and second clamping elements and an intermediate portion of the frame member between the longitudinal edges is formed of resilient material whereby resilient flexing of the intermediate portion defines both the mounting arrangement and the biasing arrangement of the handle assembly.

Preferably the frame member is curved inwardly at the longitudinal edges such that each of the first and second clamping elements comprising a clamping surface facing towards the other one of the first and second clamping elements that is convex about a respective longitudinal axis oriented in the longitudinal direction of the handle bar.

The handle assembly may further include two mounting arms extending from the handle bar in a common radial direction relative to the longitudinal direction of the handle bar, in which the mounting arms are arranged for mounting onto an object associated with the handle assembly, and in which the towel opening is located in a side surface of the handle bar that faces in the common radial direction of the mounting arms.

According to a second aspect of the present invention there is provided a handle assembly for holding a towel, the handle assembly comprising:

a handle bar extending in a longitudinal direction between opposing ends of the handle bar;

the handle bar including a hollow interior and a towel opening which is elongate in the longitudinal direction of the handle bar so as to define a pair of longitudinal edges extending in the longitudinal direction of handle bar that are spaced apart from one another so as to be arranged to receive a portion of the towel inserted into the hollow interior of the handle bar between the longitudinal edges;

a first clamping element and a second clamping element supported within the hollow interior of the handle bar and extending in the longitudinal direction of the handle bar in proximity to the pair of longitudinal edges of the towel opening respectively;

a mounting arrangement supporting the first clamping element to be movable relative to the handle bar transversely to the longitudinal direction between a released position in which the first and second clamping elements are spaced apart so as to receive said portion of the towel inserted between the clamping elements and a clamped position in which the first and second clamping elements are closer to one another than in the released position; and a biasing arrangement operatively connected between the first and second clamping elements so as to bias the first clamping element towards the clamped position;

at least one of the first and second clamping elements comprising a roller which is rotatable about a longitudinal axis oriented in the longitudinal direction of the handle bar.

Use of a roller forming one or both of the clamping elements allows for more ready insertion of a portion of the towel into the hollow interior of the handle bar between the clamping elements even when a strong clamping force is provided by the biasing arrangement.

According to a further aspect of the present invention there is provided a handle assembly for holding a towel, the handle assembly comprising:

a handle bar extending in a longitudinal direction between opposing ends of the handle bar;

the handle bar including a hollow interior and a towel opening which is elongate in the longitudinal direction of the handle bar so as to define a pair of longitudinal edges extending in the longitudinal direction of handle bar that are spaced apart from one another so as to be arranged to receive a portion of the towel inserted into the hollow interior of the handle bar between the longitudinal edges;

a frame member extending in the longitudinal direction of the handle bar within the hollow interior in which the frame member includes an intermediate portion which is generally C-shaped in profile to extend about a longitudinal axis of the frame member between opposing longitudinal edges of the frame member;

the longitudinal edges of the frame member defining a first clamping element and a second clamping element supported within the hollow interior of the handle bar and extending in the longitudinal direction of the handle bar in proximity to the longitudinal edges of the towel opening respectively; and the intermediate portion of the frame member being formed of resilient material (i) which is able to be flexed from a clamped position in which the first and second clamping elements are in proximity to one another to clamp said portion of the towel therebetween to a released position in which the first and second clamping elements are farther apart from one another than in the clamped position and (ii) which is biased from the released position to the clamped position.

Use of a single frame member which can be resiliently flexed between clamped and released positions within the hollow interior of the handle bar provides a simple low-cost construction to effectively retain towels relative to a handle bar.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
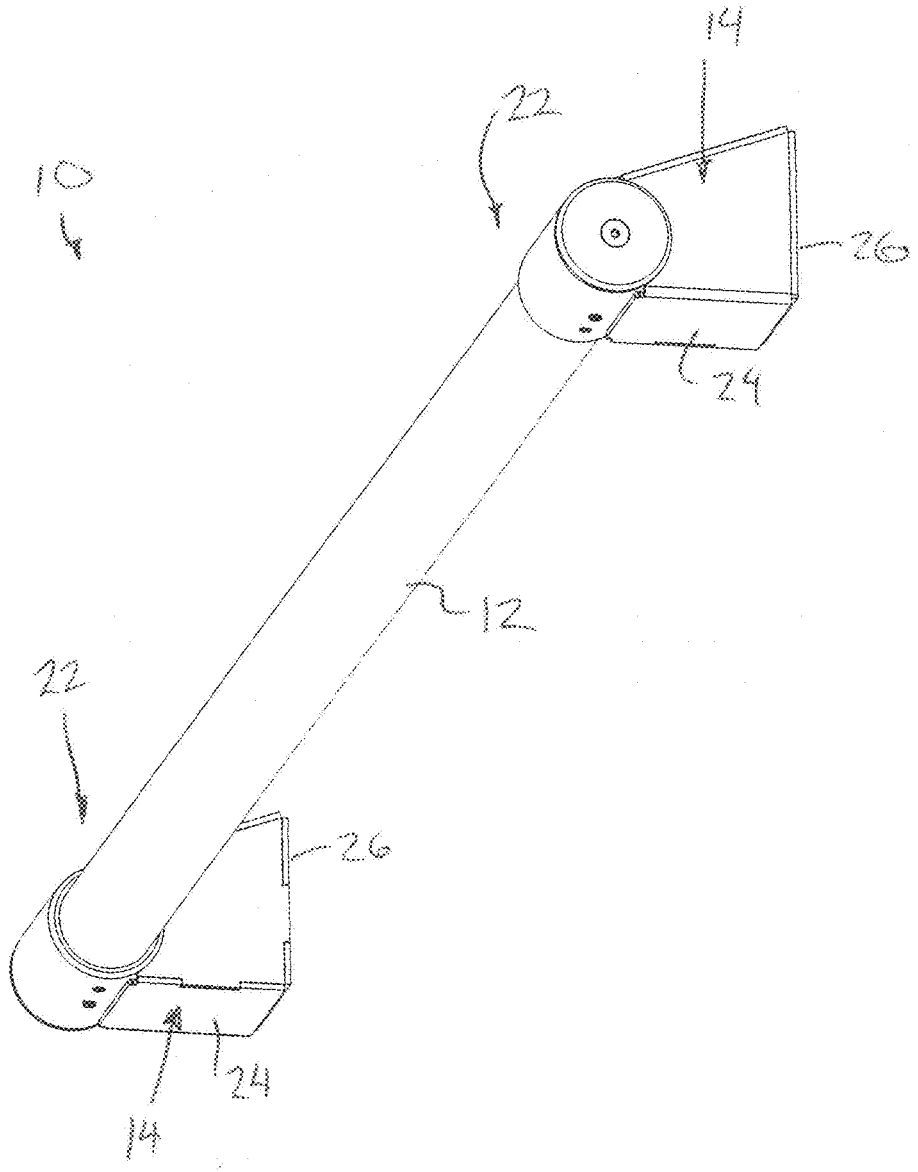
FIG. 1 is a perspective view of a front side of the handle assembly according to a first embodiment of the present invention.
Figure 2:
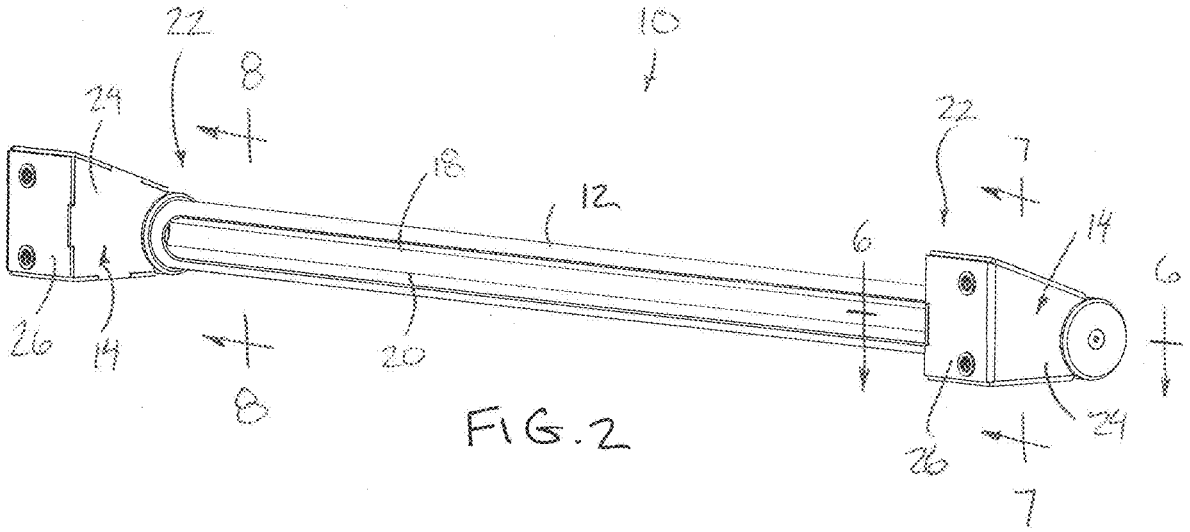
FIG. 2 is a perspective view of a rear side of the handle assembly according to the first embodiment of FIG. 1, shown in a released position of the clamping elements.
Figure 3:
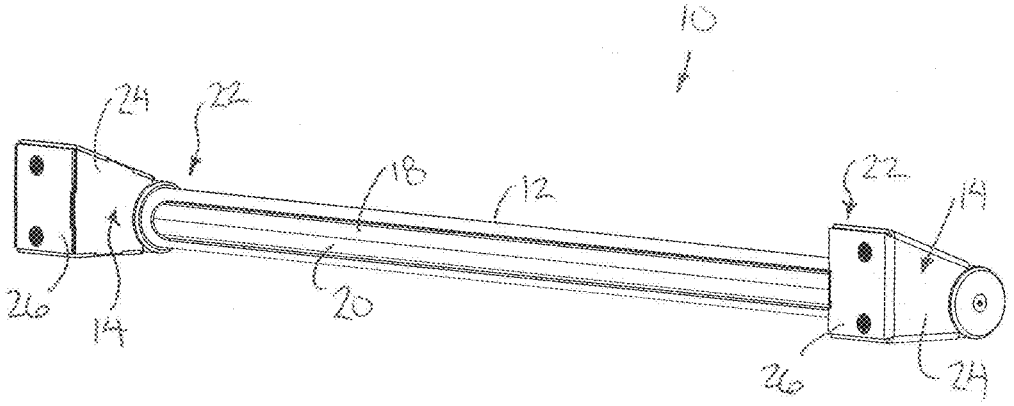
FIG. 3 is a perspective view of the rear side of the handle assembly according to the first embodiment of FIG. 1, shown in a clamped position of the clamping elements.
Figure 4:
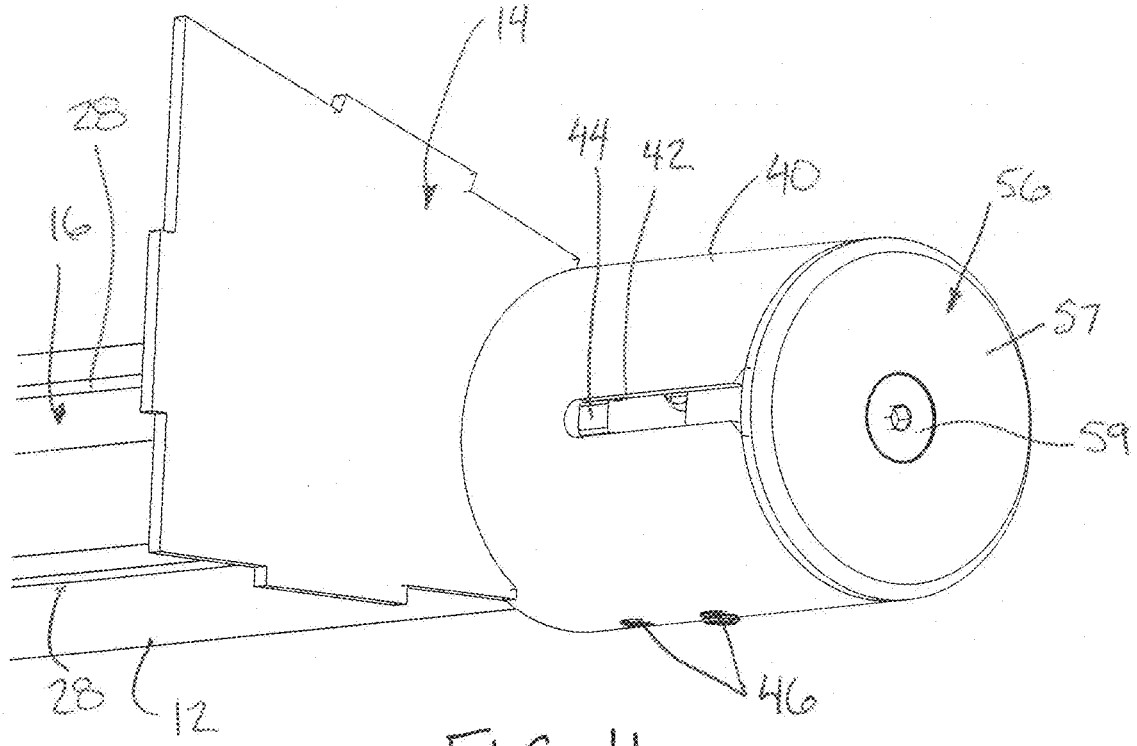
FIG. 4 is a perspective view of one end portion of the handle assembly according to the first embodiment of FIG. 1, shown with a portion of the mounting arm removed for illustrative purposes.
Figure 5:
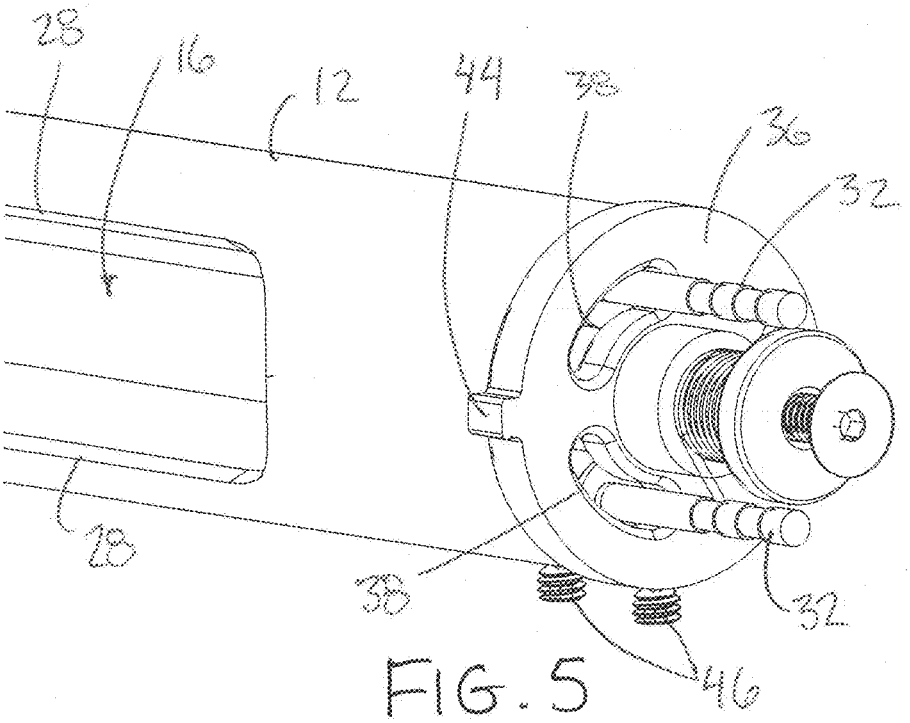
FIG. 5 is a perspective view of one end of the handle assembly according to the first embodiment of FIG. 1, shown with a section of the end portion of the handle bar removed for illustrative purposes.
Figure 6:
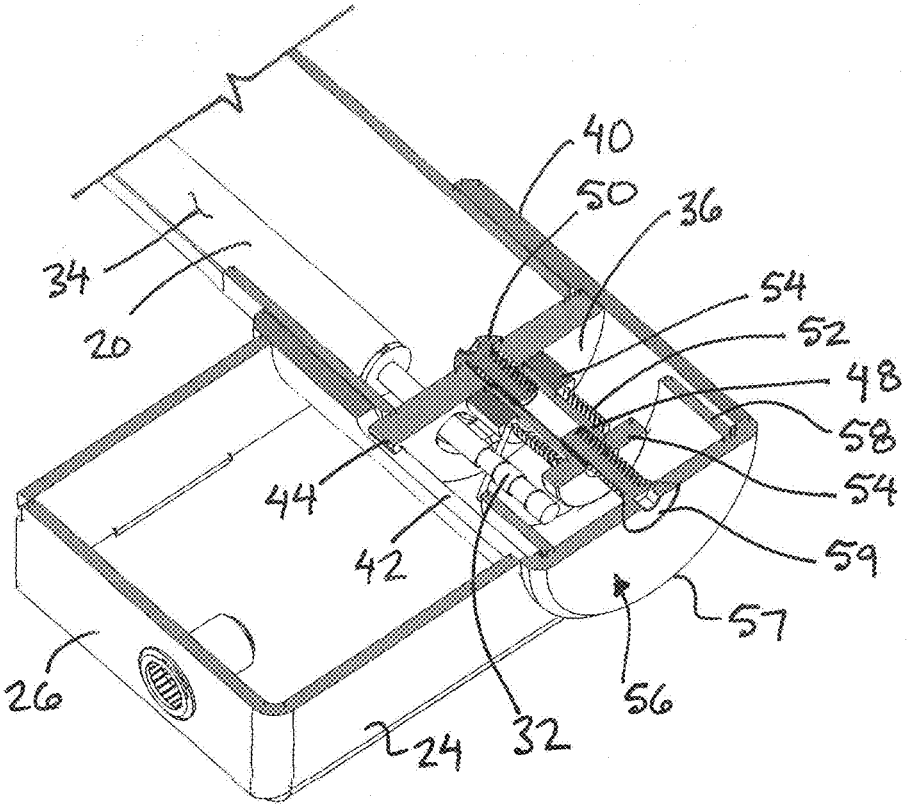
FIG. 6 is a sectional view along the line 6-6 in FIG. 2.
Figure 7:
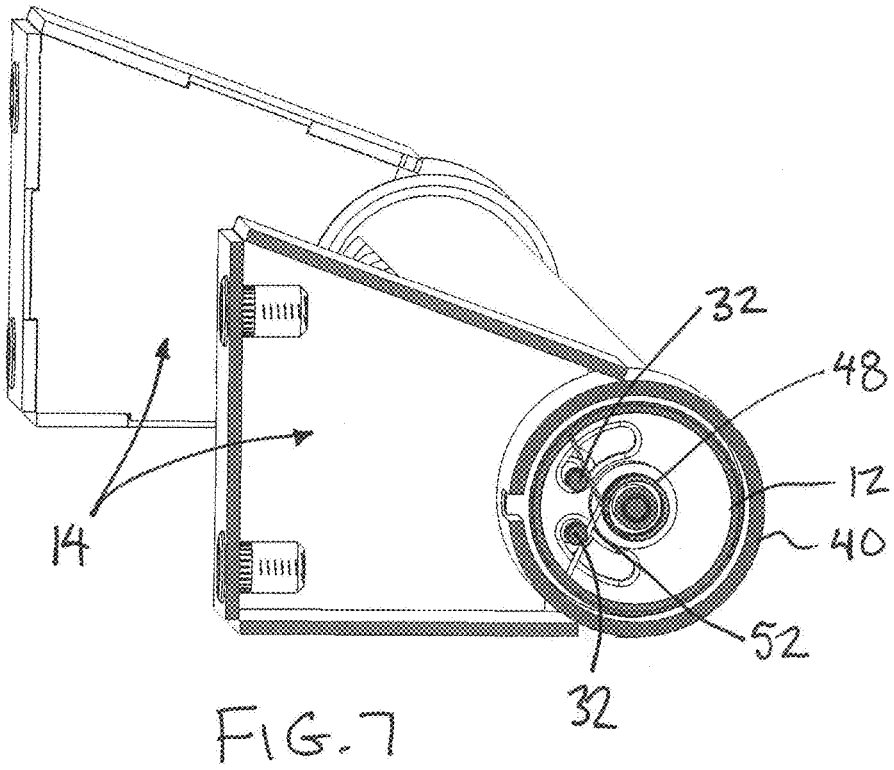
FIG. 7 is a sectional view along the line 7-7 in FIG. 2.
Figure 8:
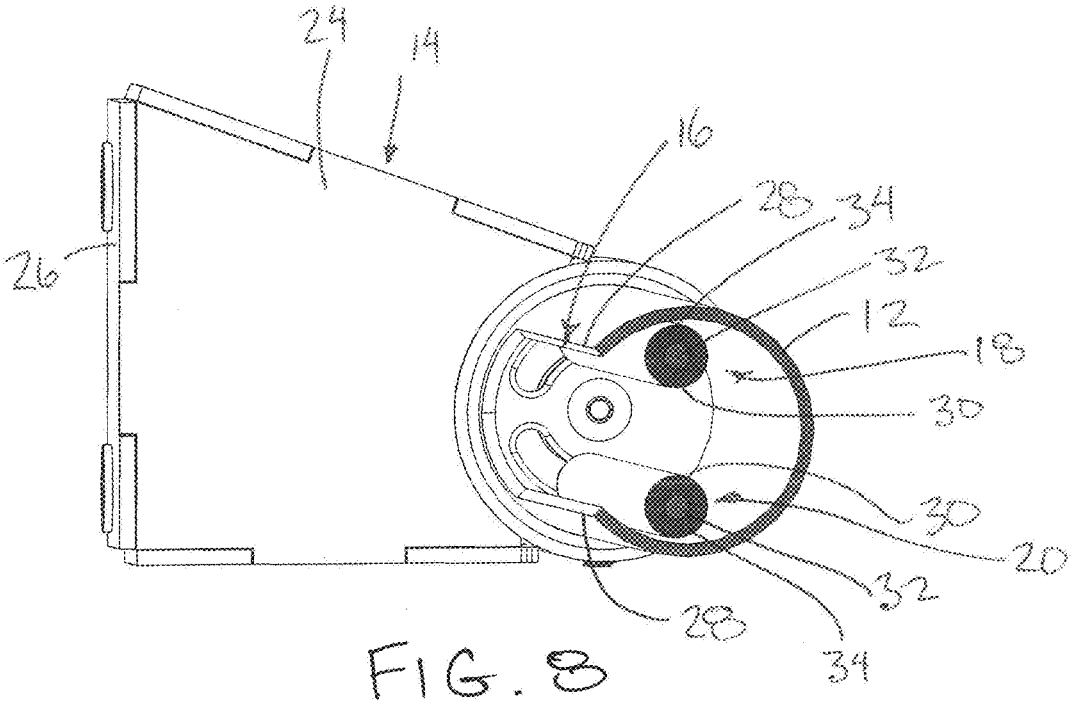
FIG. 8 is a sectional view along the line 8-8 in FIG. 2, shown in the released position.
Figure 9:
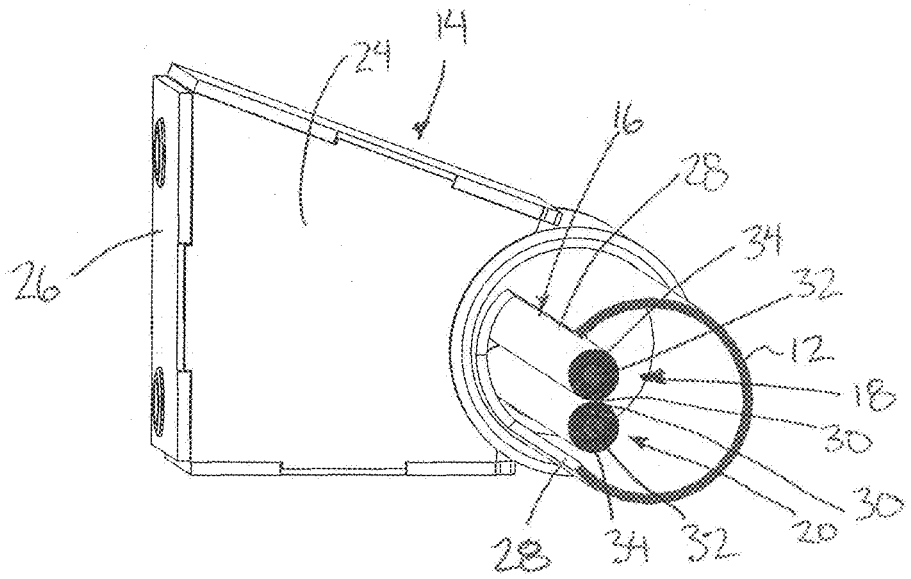
FIG. 9 is a sectional view along the line 8-8 in FIG. 2, shown in the clamped position.

Referring to the accompanying figures, there is illustrated a handle assembly generally indicated by reference numeral 10. The handle assembly 10 is suited for use for gripping in a hand of a user, for example the handle of an object such as the door handle on an oven door or other appliance for opening and closing the door. More particularly, the handle assembly is suited for gripping a towel draped over the handle assembly, for example a kitchen hand towel or dish towel of the type commonly draped over appliance handles in a residential kitchen.

The handle assembly 10 generally includes (i) a handle bar 12 for gripping in the hand of the user, (ii) mounts 14 for supporting the handle bar relative to a supporting surface of an object, (iii) a towel opening 16 in the handle bar for receiving a portion of a towel inserted into a hollow interior of the handle bar, (iv) first and second clamping elements 18 and 20 supported within the hollow interior of the handle bar, (v) a mounting arrangement supporting the clamping elements so as to be movable relative to one another in a direction transversely to a longitudinal direction of the handle bar between a released position in which the clamping elements are spaced apart so as to receive the portion of the towel inserted between the clamping element and a clamped position in which the first and second clamping elements are closer to one another than in the released position, and (vi) a biasing arrangement which biases the clamping elements towards the clamped position.

Although various embodiments are shown in the accompanying figures, the features in common with the various embodiments will first be described.

The handle bar 12 is typically elongate in a longitudinal direction between two opposing ends 22. The handle bar is typically formed of a rigid metal or plastic tube defining the hollow interior of the handle bar that extends along the full length of the handle bar about a longitudinal axis of the handle bar.

The mounts 14 each comprise a mounting arm 24 in which the mounting arms 24 extend in a common radial direction outward from the longitudinal axis of the handle bar from respective opposing ends 22 of the handle bar. Each mounting arm 24 is a hollow structure extending outward from the handle bar to a mounting plate 26 mounted at the distal end relative to the handle bar. The mounting plate is oriented perpendicularly to the radial direction of the mounting arm from the handle bar and locates fastener apertures therein to enable connection of the mounting arms to the supporting surface of the object mounting the handle assembly thereon using threaded fasteners.

The towel opening 16 is located at an inner or rear side of the handle bar, corresponding to the side surface of the handle bar which faces in the common radial direction that the mounting arms extend from the handle bar and which faces the object upon which the handle assembly is supported. The towel opening is elongate in the longitudinal direction of the handle bar, having two longitudinal edges 28 which are along opposite sides of the towel opening and which are parallel to the longitudinal axis of the handle bar. The longitudinal edges 28 of the towel opening 16 are linear, parallel to one another, and spaced apart to define a width of the slot. A plane of the opening spanning between the opposed longitudinal edges 28 is generally perpendicular to the common radial direction that the mounting arms 24 extend from the handle bar. When the handle bar is generally cylindrical in shape about the longitudinal axis thereof, the width of the towel opening may extend about the circumference of the handle bar through an arc of between 30 and 120 degrees; however, in the illustrated embodiment the width of the opening extends approximately 90 degrees about the circumference of the handle bar.

One or more of the towel openings 16 may be provided along the length of the handle bar; however, in each instance the towel opening collectively spans a majority or substantially the full length of the mounting bar in the longitudinal direction.

Each of the first and second clamping elements 18 and 20 has a respective clamping surface 30 which faces towards the other clamping element such that the clamping surfaces 30 abut one another in the clamped position. Each clamping surface is sufficiently rigid to maintain the general shape of the clamping surface. More particularly each clamping surface is generally convex about a respective longitudinal axis of the clamping element oriented in the longitudinal direction of the handle bar. In preferred embodiments, each of the clamping elements, and the clamping surfaces thereof extend substantially the full length of the towel opening and the full length of the handle bar.

The mounting arrangement typically supports the clamping elements such that both elements are movable relative to the handle bar independently of one another between the released and clamped positions. More particularly, each end of each clamping element is independently movable relative to the handle bar and relative to the opposing end of the clamping element such that the clamping surfaces of the two clamping elements can be moved into non-parallel relation with one another. More particularly the clamping elements can be positioned such that the clamping elements are spaced apart from one another in the released position thereof at one end of the handle bar while being abutted with one another in the clamped position thereof at the opposing end.

Turning now more particularly to the first embodiment shown in FIGS. 1 through 9, in this instance each clamping element comprises a roller having an inner shaft 32 extending the full length of the handle bar, and a sleeve 34 supported about the shaft 32 such that the sleeve is rotatable about a longitudinal axis of the clamping element relative to the handle bar. The shaft 32 protrudes axially beyond the sleeve 34 at both of the opposing ends thereof.

The mounting arrangement which supports the clamping elements relative to the handle bar in this instance comprises a guide plate 36 mounted at each end of the handle bar. The guide plate forms a circular cap that spans the open end of the hollow interior of the handle bar. Two guide slots 38 are formed in each guide plate for receiving the protruding end portions of the shafts 32 of the two rollers at the associated end of the handle bar. More particularly, the sleeve 34 spans substantially the full length of the handle bar between the guide plates 36 while the shaft 32 is longer to protrude through the corresponding guide slots 38 in the guide plates 36 at the opposing ends.

Each guide slot is an arcuate slot having a centre of curvature which is located in concentric alignment with the tubular shape of the surrounding handle bar. Each slot may extend through an arc of approximately 60 degrees according to the illustrated embodiment, with the inner ends of the slot being positioned in close proximity to one another, but spaced apart from one another, so that the opposing ends of the slot may be spaced apart from one another by more than 120 degrees for example. The diameters of the sleeves 34 of clamping elements are arranged such that when the shafts are abutted with the inner ends of the guide slots 38 nearest to one another within each guide plate, the sleeves 34 of the clamping elements abut one another in the clamped position. As each protruding portion of the shaft 32 is displaced within its respective guide slot outwardly and away from the other clamping element, the corresponding end of the clamping element is displaced towards the released position thereof until the shaft abuts the opposing outer end of the respective guide slot.

Each mounting arm 24 of the handle bar is coupled to the respective end of the handle bar by an outer sleeve 40 that is mounted onto the end of the mounting bar and which fixedly supports the mounting arm 24 protruding therefrom. The outer sleeve 40 has an inner diameter which is approximately equal to the outer diameter of the handle bar so as to slidably receive an end portion of the handle bar into the inner end of the outer sleeve. The outer sleeve 40 is only partially overlapped onto the end of the handle bar such that a portion of the outer sleeve protrudes axially outward beyond the end of the handle bar to support the biasing arrangement therein.

The outer sleeve 40 includes a slot 42 in one side thereof which extends in the longitudinal direction of the handle bar in alignment with a protruding tab 44 extending radially out from the peripheral edge of the guide plate. In this manner the guide plate can be aligned in the circumferential direction with the outer sleeve 40 so that the guide slots are aligned with the opposing longitudinal edges of the towel opening respectively. Set screws 46 are penetrated radially through the outer sleeve 40 where the outer sleeve overlaps the end of the handle bar to fix the orientation of the outer sleeve relative to the handle bar.

A cylindrical hub 48 is concentrically mounted onto the exterior side of each guide plate 36 by an inner screw 50 inserted through the guide plate from the interior side of the guide plate. The cylindrical hub 48 supports a coil spring 52 thereon which defines the biasing arrangement which commonly acts on the corresponding end of both clamping elements to bias the corresponding ends of the clamping elements towards the clamped position thereof. The coil spring 52 is helically wound about the cylindrical hub 48 and is tensioned between the opposing ends thereof which are anchored to the protruding portions of the two shafts 32 of the clamping elements respectively. Tension of the spring in a torsional direction about a longitudinal axis of the handle bar urges each clamping element away from the opposing clamping element in the circumferential direction at the respective end of the handle bar where the coil spring is mounted.

A pair of larger diameter collar portions 54 are mounted on the cylindrical hub 48 in which the collar portions 54 have a diameter which is larger than the diameter of the cylindrical hub. The collar portions 54 locate the coil spring 52 axially between the two collar portions 54 and assist in longitudinally positioning the spring relative to the protruding ends of the shaft 32 of the clamping elements.

An end cap 56 encloses the outer end of each outer sleeve 40. Each end cap includes a circular end wall fully spanning the outer end of the outer sleeve, and an inner sleeve 58 fixedly mounted to the inner side of the end wall 57 to extend axially inwardly therefrom. The outer diameter of the inner sleeve 58 is reduced relative to the diameter of the end wall and is sized to be near the inner diameter of the outer sleeve 40 for being slidably received therein in a mounted position. An outer fastener 59 is inserted through the end wall 57 to form a threaded connection with the end of the cylindrical hub 48 to fix the end cap relative to the outer sleeve 40 and in turn fix the end cap relative to the end of the handle bar.

The mounting arm 24 is fixed onto the respective outer sleeve 40 by welding or fastening and the like.

Each of the rollers forming the clamping elements may have a sleeve 34 formed of a soft compressible material relative to the shaft 32. The rollers are freely rotatable relative to the handle bar. An outer surface of each sleeve 34 of the clamping elements may be textured in various manners to assist in gripping a towel inserted between the clamping elements. As described above, each of the rollers is movable between the clamped and released positions thereof independently of the other roller, while each end of each roller is movable between the clamped and released positions thereof relative to the opposing end of the same roller.

Figure 10:
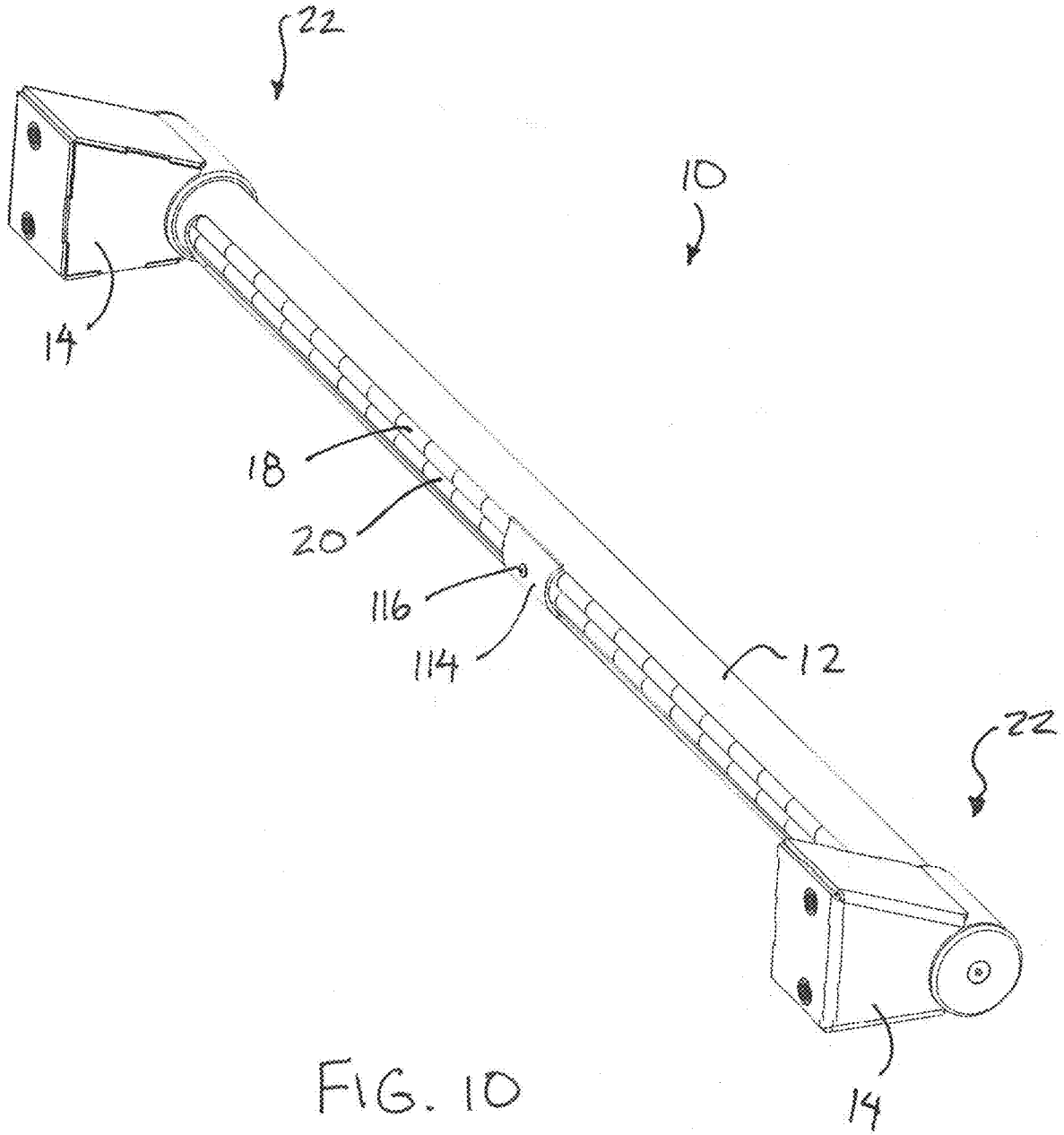
FIG. 10 is a perspective view of the rear side of the handle assembly according to a second embodiment, shown in a clamped position of the clamping elements.
Figure 11:
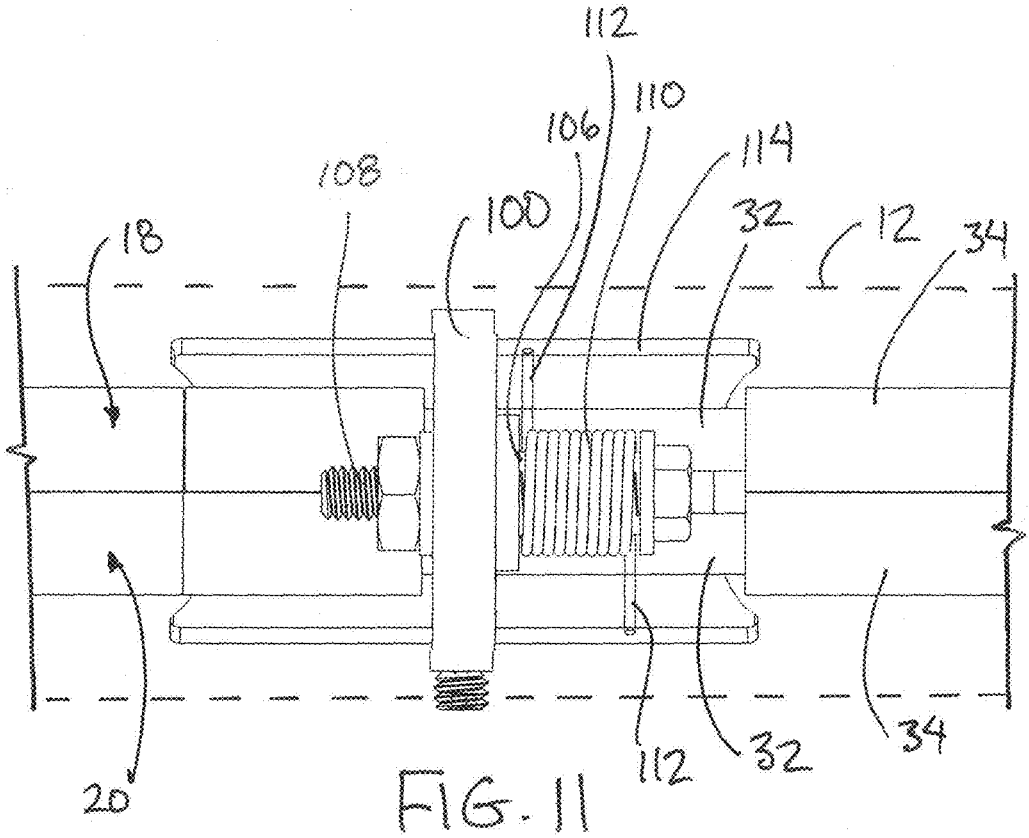
FIG. 11 is a front view of a central portion of the handle assembly according to the second embodiment of FIG. 10 with the exterior handle bar housing removed for illustrative purposes.
Figure 12:
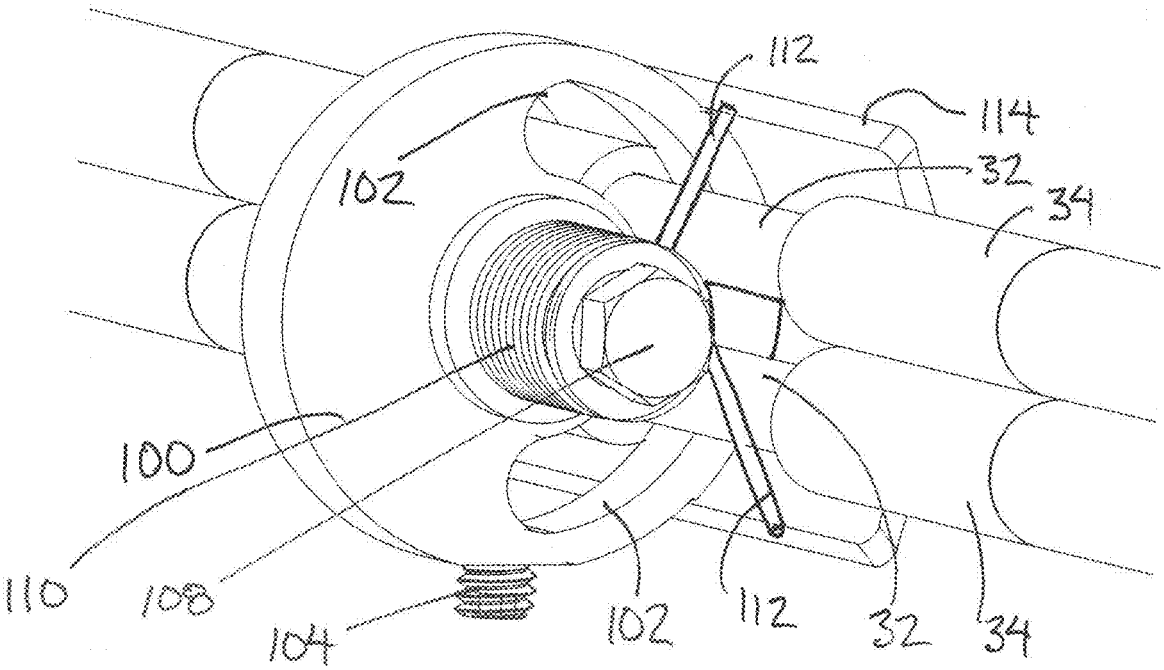
FIG. 12 is a perspective view of the central portion of the handle assembly according to the second embodiment of FIG. 10.

Turning now to the second embodiment of FIGS. 10 through 12, the handle assembly 10 in this instance is substantially identical to the previous embodiment, with the exception of some additional support and biasing being provided at an intermediate location which is centrally positioned between the opposing ends of the clamping elements so as to be spaced longitudinally inward from each of the opposing ends of the assembly.

Support is provided at the intermediate location by an intermediate guide plate 100 which is similar in configuration to the guide plates 36 provided at both ends of the assembly. More particularly, the intermediate guide plate 100 is a circular plate mounted perpendicularly to a longitudinal axis of the assembly at a central location between the opposing ends. The guide slots 102 are provided within the guide plate so as to be substantially identical to the guide slots 38 of the guide plates 36 at the opposing ends of the assembly. The two guide slots 102 each span circumferentially through an arc of approximately 60 degrees to receive the inner shafts 32 of the two clamping elements 18 and 20 within the two guide slots respectively. The guide slots thus allow the clamping elements to move through the same range of motion between clamped and released positions as described above.

The outer diameter of the intermediate guide plate 100 closely fits within the inner diameter of the tubular handle bar 12. The intermediate guide plate is fixed relative to the handlebar 12 by a lower set screw 104 which is threaded into a corresponding bore at the bottom of the handle bar 12 in alignment with a peripheral edge of the intermediate guide plate 100 such that tightening of the set screw 104 applies a frictional clamping force to the perimeter edge of the guide plate 100.

A mounting sleeve 106 is mounted coaxially with the intermediate guide plate 100 at one side of the plate using a mounting bolt 108 that extends concentrically through (i) the mounting sleeve 106 and (ii) a corresponding aperture at the centre of the intermediate guide plate 100 to fix the mounting sleeve 106 relative to the guide plate. An intermediate spring 110 is helically wound about the mounting sleeve with opposing ends of the intermediate spring comprising two legs 112 extending outward from the mounting sleeve for engaging the inner shafts 32 of the two clamping members 18 and 20 respectively. The intermediate spring 110 is pre-tensioned such that engagement of the legs 112 with the two clamping elements provides a biasing force which urges the clamping elements 18 and 20 towards one another into the clamped position thereof similarly to the springs at each of the opposing ends of the assembly.

A cover plate 114 is mounted onto the handle bar 12 to extend across the towel opening 16 at the central location to conceal the intermediate guide plate 100, the mounting sleeve 106, and the intermediate spring 110 such that they are not readily accessible through the towel opening 16 at the intermediate location. The cover plate 114 is shaped to follow the cylindrical curvature of the handlebar 12 and spans circumferentially between opposing top and bottom ends a distance which is approximately equal to the width of the towel opening between the opposing longitudinal edges 28 thereof such that the opposing top and bottom edges of the cover plate 114 can be mounted adjacent the opposing longitudinal edges 28 of the towel opening respectively. The cover plate spans in the axial direction only a small distance relative to the overall assembly so as to span the length of the mounting sleeve 106 and associated elements providing support at the intermediate location while the majority of the towel opening 16 remains unobstructed. A central set screw 116 is fastened through the cover plate 114 and into a peripheral edge of the intermediate guide plate 100 to fix the cover plate 114 in position relative to the handlebar 12.

With the cover plate 114 mounted in position, the towel opening 16 is split into two separated openings; however, the two openings collectively forming the towel opening 16 continue to span a majority of the overall length of the handlebar 12.

In the second embodiment, each of the clamping elements 18 and 20 continues to be formed by a single inner shaft 32 which spans the full length of the assembly across all of the openings collectively forming the towel opening 16 of the assembly. Although the inner shafts 32 are continuous across the length of the assembly, the sleeve 34 supported about each shaft forming each clamping element 18 and 20 is formed in at least two sections associated with the two portions of the towel opening 16 respectively. In this manner, a gap is provided within the surrounding sleeve 34 of each clamping element at the intermediate location so that the inner shafts 32 can be directly supported within the corresponding guide slots 102 and such that the inner shafts 32 can be directly engaged by the corresponding legs 112 of the intermediate spring 110.

The sleeve 34 of each clamping element 18 and 20 may be further formed in a plurality of modular sections which are independently rotatable about the respective inner shaft 32. The sleeve section 34 may be formed of a variety of materials including materials that are hard or resilient, materials that are smooth or have a textured gripping surface, plastic materials, silicone materials, etc.

Figure 13:
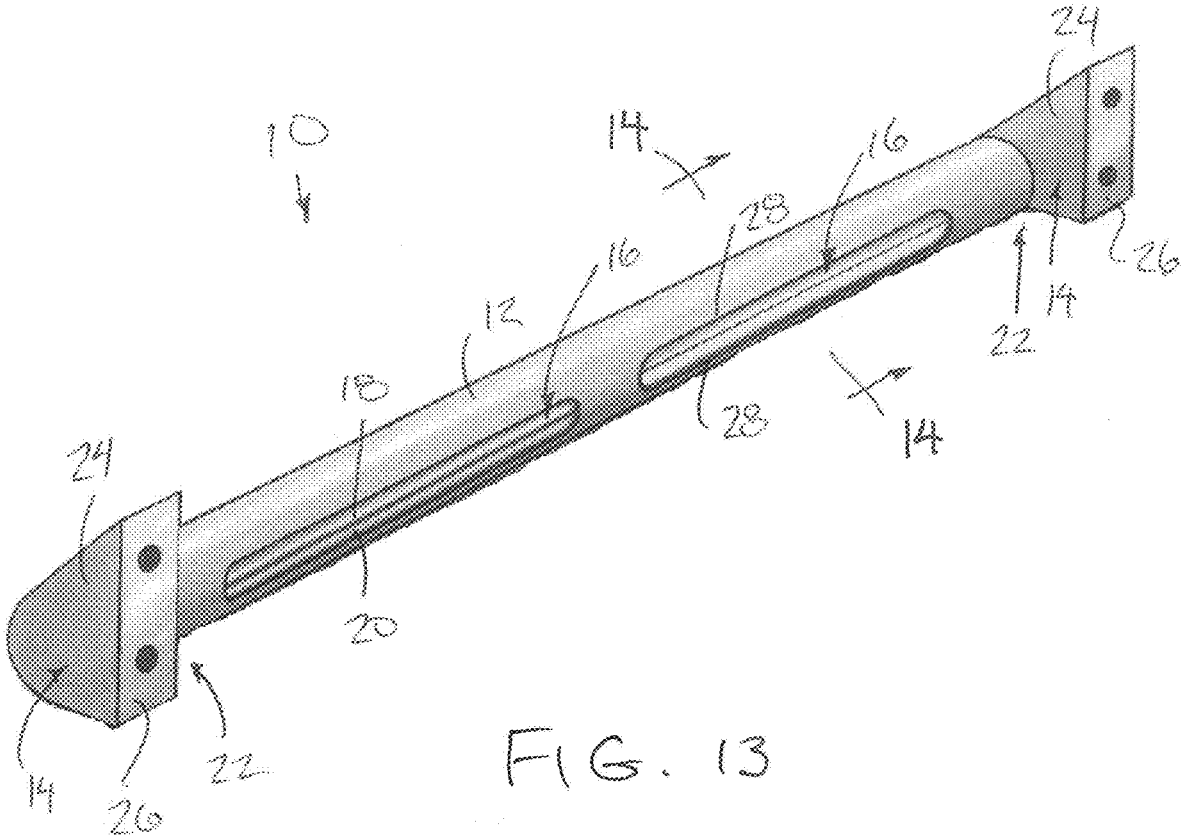
FIG. 13 is a perspective view of a rear side of the handle assembly according to a third embodiment of the present invention.
Figure 14:
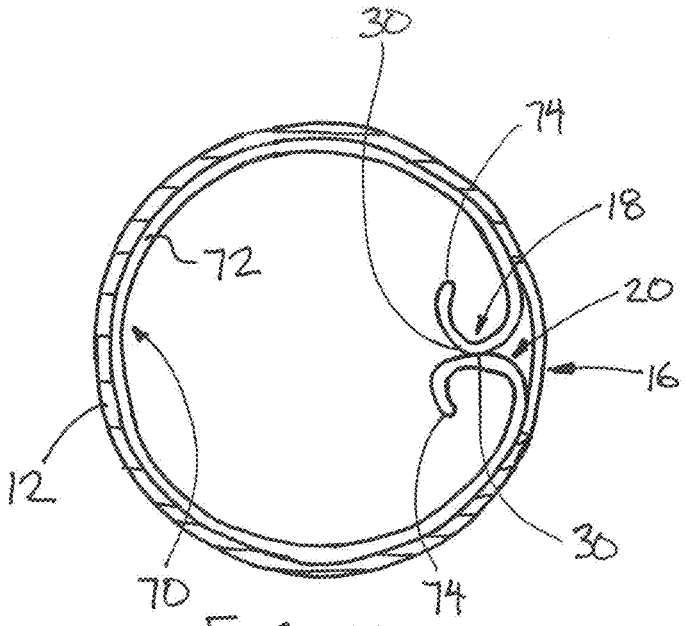
FIG. 14 is a sectional view along the line 14-14 in FIG. 13.

Turning now to the third embodiment shown in FIGS. 13 and 14, in this instance a frame member 70 is inserted into the hollow interior of the handle bar in which the frame member has a profile shape similar to the profile of the interior of the handle bar, while spanning the full length of the handle bar in the longitudinal direction. In the illustrated embodiment, the handle bar is cylindrical in shape, and the frame member is similarly cylindrical, having an outer diameter which closely matches the inner diameter of the handle bar. More particularly the profile of the frame member 70 is generally C-shaped, having an intermediate portion 72 which extends in a circumferential direction between opposing longitudinal edges 74 of the frame member. Each of the opposing longitudinal edges 74 of the frame member in the circumferential direction is curved about a respective longitudinal axis so as to define the convex shape of the clamping surfaces 30 of the first and second clamping elements that abut one another in the clamped position.

The frame member is formed integrally and uniformly of a common material which is sufficiently rigid so as to maintain the general shape of the clamping elements while being sufficiently flexible and resilient to allow some distortion of the shape. The frame member is generally biased to return to a clamped position in which the clamping elements abut one another while the frame member extends about the full circumference within the interior of the handle bar.

Inserting a portion of a towel into the towel opening so as to force a portion of the towel between the clamping elements causes each of the clamping elements to follow a path towards the released position thereof similarly to the path of the first embodiment. More particularly the clamping elements diverge further apart from one another as the clamping elements are urged inwardly further into the hollow interior of the handle bar and away from a plane of the towel opening defined between the longitudinal edges 28 thereof. In this manner, the intermediate portion 72 of the frame member defines the mounting arrangement that supports the clamping elements relative to one another and relative to the handle bar so as to be movable between the clamped and released positions by flexing of the intermediate portion. Furthermore, the resilient nature of the material forming the frame member which is biased to return to the clamped position also defines the biasing arrangement described above.

In further embodiments, a frame member 70 according to the second embodiment may support clamping elements in which one or both of the clamping elements comprises a roller supported for movement between the clamped and released positions thereof.

In further embodiments, regardless of the mounting arrangement used to support the clamping elements, one of the clamping elements may be fixed relative to the handle bar such that only one of the clamping elements is movable relative to the handle bar between the clamped and released positions thereof.

In further embodiments, either one of the clamping elements may comprise a roller while the other clamping element is a non-roller or other type of fixed surface against which the rollers clamped.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A handle assembly for holding a towel, the handle assembly comprising:

a handle bar extending in a longitudinal direction between opposing ends of the handle bar;

the handle bar including a hollow interior and a towel opening which is elongate in the longitudinal direction of the handle bar so as to define a pair of longitudinal edges extending in the longitudinal direction of handle bar that are spaced apart from one another so as to be arranged to receive a portion of the towel inserted into the hollow interior of the handle bar between the longitudinal edges;

a first clamping element and a second clamping element supported within the hollow interior of the handle bar and extending in the longitudinal direction of the handle bar in proximity to the pair of longitudinal edges of the towel opening respectively;

a mounting arrangement supporting the first and second clamping elements to be movable relative to the handle bar transversely to the longitudinal direction between a released position in which the first and second clamping elements are spaced apart so as to receive said portion of the towel inserted between the clamping elements and a clamped position in which the first and second clamping elements are closer to one another than in the released position; and a biasing arrangement operatively connected to the first and second clamping elements so as to bias the first and second clamping elements towards the clamped position.

2. The handle assembly according to claim 1 wherein the first and second clamping elements are independently movable between the clamped and released positions.

3. The handle assembly according to claim 1 wherein each clamping element is supported at longitudinally opposing ends of the clamping element such that the opposing ends of the clamping element are independently moveable between the clamped position and the released position.

4. The handle assembly according to claim 1 wherein the biasing arrangement includes outer springs supported at opposing ends of the handle bar such that the opposing ends of the clamping elements are biased towards the clamped position independently of one another by the springs.

5. The handle assembly according to claim 1 wherein the biasing arrangement includes an intermediate spring supported at an intermediate location spaced inwardly from opposing ends of the clamping elements, the intermediate spring being operatively connected to both of the first and second clamping elements for urging both clamping elements towards the clamped position thereof.

6. The handle assembly according to claim 1 wherein each of the first and second clamping elements is displaced inwardly into the hollow interior of the handle bar away from a plane of the towel opening in the handle bar as the clamping element is displaced from the clamped position towards the released position.

7. The handle assembly according to claim 6 wherein each of the first and second clamping elements follows an arcuate path about a longitudinal axis oriented in the longitudinal direction of the handle bar between the clamped and released positions.

8. The handle assembly according to claim 1 wherein each of the first and second clamping elements is supported at opposing ends within a respective guide slot which guides movement of the clamping element between the clamped and released positions.

9. The handle assembly according to claim 8 wherein each of the first and second clamping elements is supported at an intermediate location spaced inwardly from opposing ends of the clamping element within a respective guide slot which guides movement of the clamping element between the clamped and released positions.

10. The handle assembly according to claim 1 wherein the towel opening comprises one or more openings spanning a majority of a length of the handle bar and wherein the first and second clamping elements span a full length of the one or more towel openings.

11. The handle assembly according to claim 1 wherein each of the first and second clamping elements includes a clamping surface facing towards the other one of the first and second clamping elements that is convex about a longitudinal axis oriented in the longitudinal direction of the handle bar.

12. The handle assembly according to claim 1 wherein each of the first and second clamping elements includes a clamping surface facing towards the other one of the first and second clamping elements that is rigid.

13. The handle assembly according to claim 1 wherein at least one of the first and second clamping elements comprises a roller which is rotatable about a longitudinal axis oriented in the longitudinal direction of the handle bar.

14. The handle assembly according to claim 1 wherein each of the first and second clamping elements comprises a roller which is rotatable about a longitudinal axis oriented in the longitudinal direction of the handle bar.

15. The handle assembly according to claim 13 wherein the roller has a textured surface.

16. The handle assembly according to claim 1 further comprising a frame member extending in the longitudinal direction of the handle bar within the hollow interior, the frame member being generally C-shaped in profile to extend about a longitudinal axis of the frame member between opposing longitudinal edges of the frame member, the longitudinal edges of the frame member defining the first and second clamping elements and an intermediate portion of the frame member between the longitudinal edges being formed of resilient material whereby resilient flexing of the intermediate portion defines both the mounting arrangement and the biasing arrangement of the handle assembly.

17. The handle assembly according to claim 16 wherein the frame member is curved inwardly at the longitudinal edges such that each of the first and second clamping elements comprising a clamping surface facing towards the other one of the first and second clamping elements that is convex about a respective longitudinal axis oriented in the longitudinal direction of the handle bar.

18. The handle assembly according to claim 1 further comprising two mounting arms extending from the handle bar in a common radial direction relative to the longitudinal direction of the handle bar, the mounting arms being arranged for mounting onto an object associated with the handle assembly, and the towel opening being located in a side surface of the handle bar that faces in the common radial direction of the mounting arms.

19. A handle assembly for holding a towel, the handle assembly comprising:

a handle bar extending in a longitudinal direction between opposing ends of the handle bar;

the handle bar including a hollow interior and a towel opening which is elongate in the longitudinal direction of the handle bar so as to define a pair of longitudinal edges extending in the longitudinal direction of handle bar that are spaced apart from one another so as to be arranged to receive a portion of the towel inserted into the hollow interior of the handle bar between the longitudinal edges;

a first clamping element and a second clamping element supported within the hollow interior of the handle bar and extending in the longitudinal direction of the handle bar in proximity to the pair of longitudinal edges of the towel opening respectively;

a mounting arrangement supporting the first clamping element to be movable relative to the handle bar transversely to the longitudinal direction between a released position in which the first and second clamping elements are spaced apart so as to receive said portion of the towel inserted between the clamping elements and a clamped position in which the first and second clamping elements are closer to one another than in the released position; and a biasing arrangement operatively connected between the first and second clamping elements so as to bias the first clamping element towards the clamped position;

at least one of the first and second clamping elements comprising a roller which is rotatable about a longitudinal axis oriented in the longitudinal direction of the handle bar.

20. A handle assembly for holding a towel, the handle assembly comprising:

a handle bar extending in a longitudinal direction between opposing ends of the handle bar;

the handle bar including a hollow interior and a towel opening which is elongate in the longitudinal direction of the handle bar so as to define a pair of longitudinal edges extending in the longitudinal direction of handle bar that are spaced apart from one another so as to be arranged to receive a portion of the towel inserted into the hollow interior of the handle bar between the longitudinal edges;

a frame member extending in the longitudinal direction of the handle bar within the hollow interior in which the frame member includes an intermediate portion which is generally C-shaped in profile to extend about a longitudinal axis of the frame member between opposing longitudinal edges of the frame member;

the longitudinal edges of the frame member defining a first clamping element and a second clamping element supported within the hollow interior of the handle bar and extending in the longitudinal direction of the handle bar in proximity to the longitudinal edges of the towel opening respectively; and the intermediate portion of the frame member being formed of resilient material (i) which is able to be flexed from a clamped position in which the first and second clamping elements are in proximity to one another to clamp said portion of the towel therebetween to a released position in which the first and second clamping elements are farther apart from one another than in the clamped position and (ii) which is biased from the released position to the clamped position.

* * * * *